US007357248B2

(12) United States Patent
Sivakumar et al.

(10) Patent No.: US 7,357,248 B2
(45) Date of Patent: Apr. 15, 2008

(54) POINT OF USE CLEANING SOLUTION

(75) Inventors: Ram Sivakumar, Edison, NJ (US); John Skoufis, Denville, NJ (US)

(73) Assignee: Illinois Tool Works Inc., Glenview, IL (US)

( * ) Notice: Subject to any disclaimer, the term of this patent is extended or adjusted under 35 U.S.C. 154(b) by 453 days.

(21) Appl. No.: 11/011,228

(22) Filed: Dec. 14, 2004

(65) Prior Publication Data

US 2006/0124476 A1 Jun. 15, 2006

(51) Int. Cl.
*B65D 69/00* (2006.01)

(52) U.S. Cl. ..... 206/219; 206/223; 206/484; 206/812

(58) Field of Classification Search ..... 206/207, 206/233, 210, 205, 812, 222, 219, 440, 223, 206/221, 581, 484, 568, 220, 204; 383/38
See application file for complete search history.

(56) References Cited

U.S. PATENT DOCUMENTS 2,999,265 A * 9/1961 Duane et al. ..... 424/443
3,393,796 A * 7/1968 Clarke ..... 206/205
5,267,646 A * 12/1993 Inoue et al. ..... 206/204
5,287,961 A * 2/1994 Herran ..... 206/219
5,616,337 A * 4/1997 Kasianovitz et al. ..... 424/414
6,001,187 A 12/1999 Paley et al.
6,062,381 A 5/2000 Paley et al.
6,082,534 A * 7/2000 Dotson ..... 206/210
6,827,080 B2 * 12/2004 Fish et al. ..... 126/263.01
6,945,402 B1 * 9/2005 Gueret ..... 206/581
2004/0065315 A1 4/2004 Fish et al.

FOREIGN PATENT DOCUMENTS

EP 0 594 449 A 4/1994
WO WO 93/10019 A 5/1993

OTHER PUBLICATIONS

PCT/US2005/031293, Aug. 30, 2005, Sivakumar et al., Search Report.

* cited by examiner

*Primary Examiner*—Mickey Yu
*Assistant Examiner*—Steven A. Reynolds
(74) *Attorney, Agent, or Firm*—Mark W. Croll; Donald J. Breh; Levenfeld Pearlstein, LLC

(57) ABSTRACT

A cleaning solution kit includes a liquid that is disposed within a first compartment and that is isolated from a cleaning solid disposed in a second compartment by a first openable barrier. When the first openable barrier is opened, the liquid and cleaning solid are exposed to one another, forming the cleaning solution. A cleaning kit includes the first and second compartments of the cleaning solution kit and also includes wipes. The wipes are disposed within a third compartment and are isolated from the cleaning solid and the liquid by a second openable barrier and the first openable barrier. When wipes are needed to clean an area, after the cleaning solution is formed by opening the first openable barrier, the second barrier is opened and the cleaning solution wets the wipes. The wipes are then ready for cleaning surfaces within an area.

11 Claims, 4 Drawing Sheets

POINT OF USE CLEANING SOLUTION

BACKGROUND OF THE INVENTION

The present invention pertains to an apparatus and method for providing cleaning solutions. In particular, the present invention pertains to providing cleaning solutions of sufficient strength or potency to comply with predetermined standards, for example, governmental standards, for particular applications, such as cleaning laboratories.

Many attempts have been made to provide effective ways to clean areas. One of the most easy and prevalent ways to achieve clean areas is by wiping the surfaces of an area with a cleaning solution and a wipe. Cleaning agent is intended to include disinfectants, sanitizers, antimicrobials, virucides, fungicides, and the like and is intended to encompass the active ingredients and not additives such as detergents, surfactants, stabilizing agents and the like.

One method is to use a prepared liquid bleach and/or other prepared cleaning solutions to clean areas. The liquid bleach or other cleaning solution is applied to the surface and the surface is scrubbed with a wipe, or the liquid bleach or cleaning solution is applied to the wipe and then the surface is scrubbed with the wipe.

Cleanliness of certain preparation area or rooms is becoming a bigger issue for a diverse group of organizations such as pharmaceutical and medical device manufacturers, industrial research facilities, patient care facilities, and animal research facilities. Cleaning is an especially important issue for pharmaceutical testing laboratories. Specifically, clean animal facilities are critical to the health and well-being of the animals, researchers, and animal care technicians who live and work in the facility. Clean facilities also help to ensure the accuracy of research by keeping potential contaminants at bay.

Because of the importance of clean rooms in these various industries, the government and other organizations have provided guidelines for the concentration of cleaning agents used in the cleaning solutions. For example, when bleach is used, it must have a concentration of at least 1000 parts per million (ppm) of available chlorine for general purpose disinfection, which is a cleaning agent within a bleach formula.

Liquid cleaning solutions, however, are replete with problems. Most liquid cleaning solutions, especially liquid bleach, lose their cleaning potency over time because the cleaning agents react with water molecules, metals, heat and environmental conditions to undergo hydrolysis and other reactions. For example, thirty to fifty percent of the chlorine in liquid bleach deteriorates over time because of hydrolysis and other reactions. As a result, if liquid bleach is used during cleaning operations, there is an increased probability that the concentration of active chlorine will drop below the minimum needed for disinfection.

Further, when liquid cleaning solutions are used, there is often too little solution used, leaving an unsanitized environment; and, in other cases, there is too much solution used, resulting in solution wastage. Liquid cleaning solution may also be spilled, resulting in unsafe conditions.

To alleviate some of these problems, pre-wetted wipes that are wetted with the appropriate amount of cleaning solution have been used. A problem with these wipes, however, is that, in addition to the cleaning solution losing its strength or potency over time, the solution reacts with most common fabrics used for the wipes. The reaction causes degradation of the wiping material and of the cleaning agents within a short period of time.

As provided in U.S. Pat. Nos. 6,062,381 and 6,001,187, Paley and others addressed the wipe degradation issue. These patents disclose a small container that stores the appropriate amount of cleaning solution. The smaller container is positioned within a larger container, which encloses the wipes. When the wipes are needed for cleaning purposes, the smaller container is broken, releasing the liquid onto the wipes. Because the cleaning solution and the wipes were isolated, there was reduced, if any, wipe degradation. But, the cleaning solution still loses its potency over time.

As a result, there still exists a need for an apparatus and method for providing cleaning solutions that have sufficient potency to adequately clean areas when the solutions will be used, at the point of use.

BRIEF SUMMARY OF THE INVENTION

The present invention pertains to an apparatus and method for providing cleaning solutions that have sufficient potency at the point of use to adequately clean areas, per predetermined standards.

In a first embodiment cleaning solution kit of the invention, a cleaning solid is positioned within a second compartment and isolated from a liquid positioned within a first compartment by a first openable barrier. The first and second compartments are linearly aligned.

The first openable barrier is a seal, which, when opened, allows the liquid and the cleaning solid to mix to form the cleaning solution. Preferably, the first openable barrier is opened around the time that the cleaning solution will be used to clean an area. Because the cleaning solution includes the active cleaning agent and because the solution will be used shortly after it is formed, problems of deteriorating cleaning agents through hydrolysis and other reactions are alleviated.

In a second embodiment of a cleaning kit of the invention, a third compartment with wipes positioned therein is used in conjunction with the first embodiment cleaning solution kit. Specifically, the wipes are isolated from the cleaning solid and liquid by second and first openable barriers. After the first openable barrier is opened to form the cleaning solution, the second openable barrier is opened, allowing the newly formed cleaning solution to wet the wipes. The wipes may then be used to clean an area.

In a third embodiment of a cleaning solution kit of the invention, the second compartment is positioned within the first embodiment. The second compartment comprises a tube, and the first openable barrier comprises a crushable vial positioned within the tube and liquid resistant plugs positioned at ends of the tube. The cleaning solid is positioned within the vial.

When the tube is compressed, the vial is crushed and the increased pressure within the tube causes the plugs to be forced from the ends of the tube. Alternately, the vial can be enclosed within a porous sleeve to contain any glass fragments. The liquid then enters the tube and vial and mixes with the cleaning solid to form the cleaning solution.

A fourth embodiment of a cleaning kit of the invention includes a third compartment having wipes positioned therein that is used with the third embodiment cleaning solution kit. Specifically, the wipes in the third compartment are isolated from the cleaning solid and the liquid by a second openable barrier, which can be a seal, and the first openable barrier. After the cleaning solution is formed by pressing on the plastic tube, the seal of the second openable barrier is opened, allowing the cleaning solution to wet the wipes. The wipes may then be used to clean an area.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
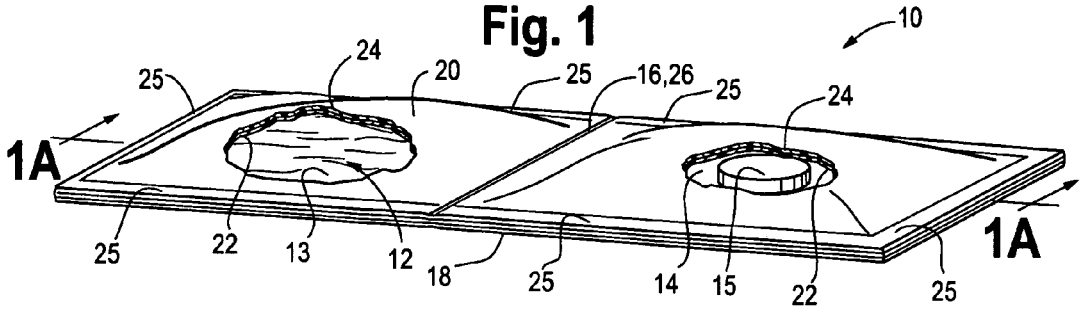
FIG. 1 is an isometric view of a first embodiment of a cleaning solution kit of the invention having portions of the first and second compartments cut out.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Cleaning solution kit embodiments of the present invention pertain to a method and apparatus for providing cleaning solutions with sufficient strength or potency to meet predetermined cleaning agent guidelines or standards prescribed by, for example, governmental agencies or industry standard setting organizations. In one embodiment, a liquid is positioned within a first compartment and isolated from a cleaning solid positioned in a second compartment. The cleaning solid and liquid are isolated by an openable barrier, which can be opened when the cleaning solution is needed, e.g., at the point of use. When needed, the barrier is opened, and the liquid and cleaning solid are exposed to one another, forming the cleaning solution.

The newly formed cleaning solution includes the cleaning agent, and because the cleaning solution is formed at the point of use, the cleaning agent does not materially deteriorate because of hydrolysis and/or other reactions, prior to dissolution with water, that cause known liquid cleaning solutions to lose their potency. As a result, the cleaning solution kit can be stored for extended periods and still provide cleaning solutions of sufficient strength or potency to comply with governmental guidelines. It will be appreciated that sufficient strength or potency means that a sufficiently high concentration of the "cleaning agent" of the formulation is present, such that the solution falls within the governmental or industry standards or guidelines.

Cleaning kit embodiments of the invention also include wipes that are positioned within a third compartment and that are isolated from the cleaning solid and the liquid by first and second openable barriers. When wipes are needed to clean an area, after the cleaning solution is formed by opening the first barrier, the second barrier is opened and the cleaning solution wets the wipes. The wipes are then ready for cleaning surfaces within an area.

Figure 1A:
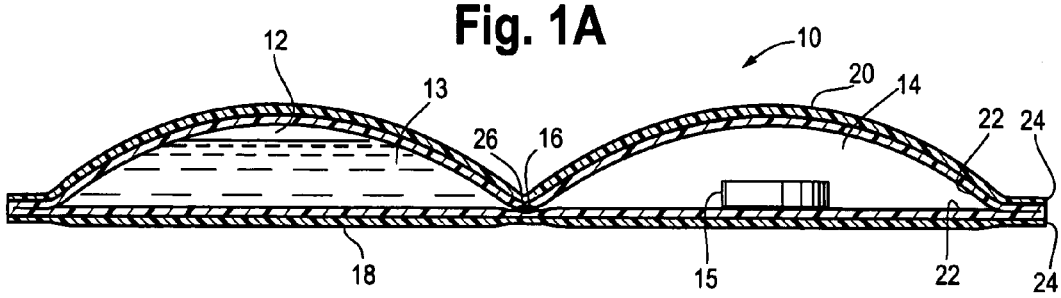
FIG. 1A is a cross-sectional view taken along line 1A-1A of FIG. 1.
Figure 2:
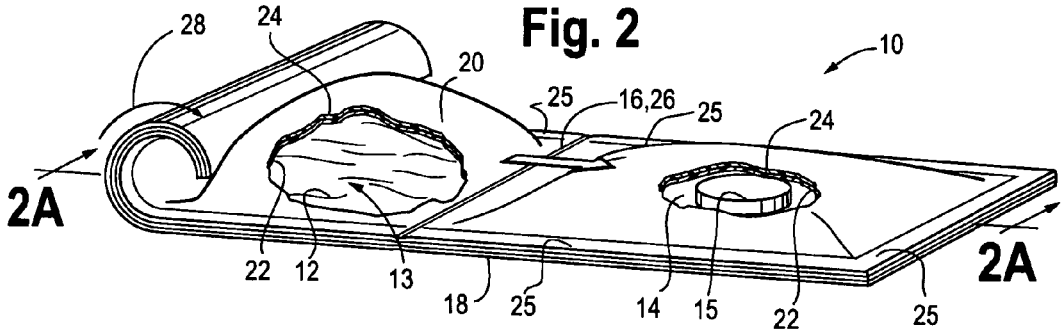
FIG. 2 is an isometric view of the first embodiment of a cleaning solution kit of the invention showing how a first compartment of the first embodiment may be rolled.
Figure 2A:
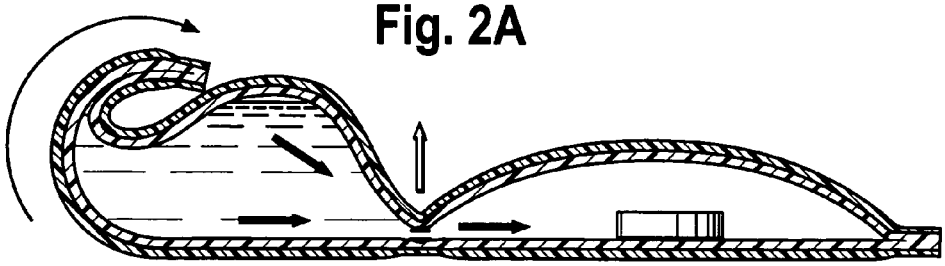
FIG. 2A is a cross-sectional view taken along line 2A-2A of FIG. 2.

A first embodiment of the cleaning solution kit 10 shown in FIGS. 1 and 1*a* includes first and second compartments 12, 14 separated by a first openable barrier 16. The liquid 13 is positioned within the first compartment 12 and is isolated from the cleaning solid 15, which is positioned within the second compartment 14. In one embodiment, the compartments 12, 14 are preferably formed from bottom and top panels 18, 20, each comprised of an inner and outer layer 22, 24 of plastic. The inner layers 22 of the bottom and top panels 18, 20 are sealed together at a periphery 25 and at the first openable barrier 16 to form the first and second compartments 12, 14.

It is important to be able to control the strength of the seal 26 of the first openable barrier 16 to control how much pressure is necessary to open the seal. Thus, the inner layers 22 are preferably comprised of a material that allows for increased control of the strength of the seal 26 of the first openable barrier 16 and, therefore, increased control of the pressure required to open the first openable barrier. In one specific embodiment, the inner layer 22 includes two mil (2/1000 inches) low density polyethylene (LDPE), which provides sufficient control of the strength of the seal 26.

Typically, materials that allow for sealing strength control are permeable to air and liquid. To prevent unwanted reactions caused by air and liquid transpiring through the inner layer 22, an outer impermeable layer 24 is used in the first cleaning solution kit embodiment 10. Preferably, the outer layer 24 is sufficiently strong to prevent unwanted tearing of either compartment 12, 14 and prevent unintended and undesired air and liquid from the environment transpiring into either compartment. In one specific embodiment, the outer layer 24 is comprised of 48-gauge high barrier polyester. The inner and outer layers 22, 24 are sealed together, for example, by co-extrusion, to minimize and preferably eliminate air, liquid or any other contaminant between the inner and outer layers.

The first openable barrier 16 separating the liquid 13 from the cleaning solid 15 positioned within the first and second compartments 12, 14 should be strong enough to prevent unintentional opening but be readily openable so that, when the cleaning solution is needed, the first openable barrier 16 may be opened by individuals of varying strengths.

In the first embodiment, as described in greater detail below, the seal 26 of the first openable barrier 16 is formed by applying heat at a desired location and in a desired shape of the first openable barrier. Specifically, the top and bottom panels 20, 18 are sealed together by applying heat to the panels so that the inner layers 22 of the top and bottom panels 20, 18 are sealed to themselves. In the first embodiment, the first openable barrier 16 is straight, and the seal strength of the first openable barrier may be adjusted by adjusting the pressure, temperature, seal width and time of heat application to the top and bottom panels 20, 18.

Adhesion and other materials and methods may also be used to form the first openable barrier 16 and to seal the periphery. But, when using adhesive to form the barrier and seal the periphery, the adhesive may seep into and contaminate the liquid and/or cleaning solid in the first and second compartments 12, 14, respectively. As a result, heat seals are preferred. Those of skill in the art, however, will appreciate that several other types of seals not shown nor described may be utilized to form the first openable barrier.

In the first embodiment, the first and second compartments 12, 14 are in a linear configuration, as shown in FIGS. 1, 1A, 2 and 2A. The first and second compartments 12, 14 are linearly configured to allow for rolling of the first compartment 12 in the direction of arrow 28 toward the second compartment 14, which rolling will create enough pressure to open the first openable barrier 16.

The first embodiment may also include other configurations not shown, such as vertical configurations where the first compartment is positioned above (or below) the second compartment. In a vertical configuration, the openable barrier can be between the first and second compartments. For example, the barrier may be below the first compartment if the first compartment is above the second compartment. The type, positioning and strength of the first openable barrier may be adjusted based on various factors, such as the configuration of the compartments, the maximum strength seal that may be used based on the individuals who will be opening the first openable barrier and the like.

Figure 3:
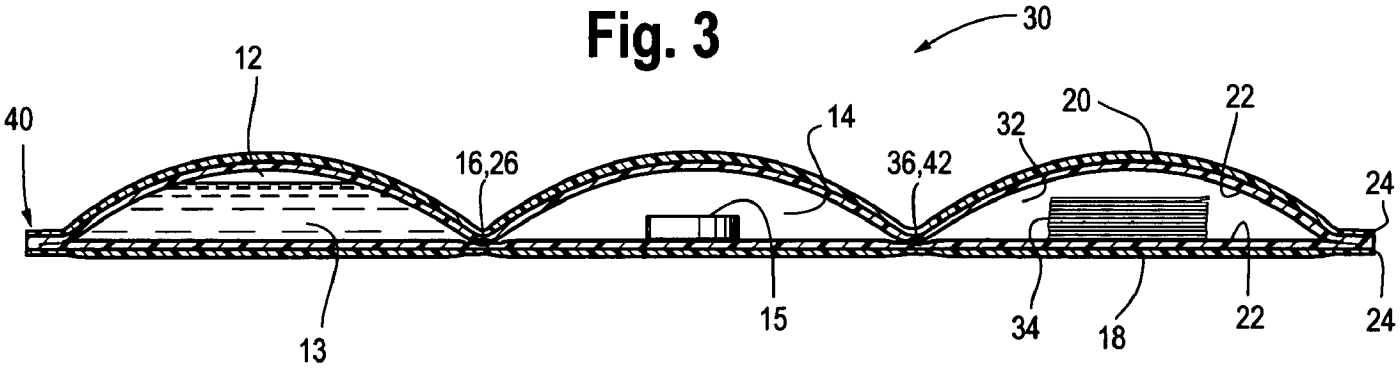
FIG. 3 is a cross-sectional view of a second embodiment of a cleaning kit of the invention.

A second embodiment of the invention comprises a cleaning kit 30 shown in FIG. 3. The second embodiment cleaning kit 30 includes the two compartment 12, 14 configuration of the first embodiment cleaning solution kit 10 and an additional third compartment 32. The third compartment 32 is comprised of the same top and bottom panels 20, 18 that form the first and second compartments 12, 14. In addition, the third compartment 32 includes wipes 34 that are isolated from the cleaning solid 15 and liquid 13 of the first and second compartments 12, 14 by a second openable barrier 36 and the first openable barrier 16.

The second openable barrier 36 is preferably opened a predetermined time after the first openable barrier 16 is opened, during which time the cleaning solid 15 and liquid 13 mix to form the cleaning solution. After the cleaning solution is formed and the second openable barrier 36 is opened, the cleaning solution enters into the third compartment 32 and saturates the wipes 34.

Figure 4:
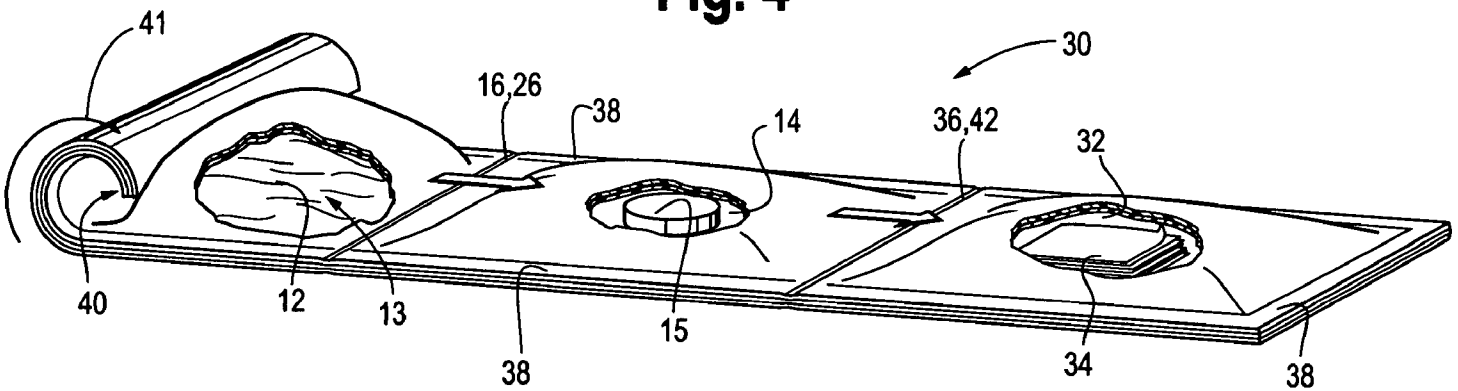
FIG. 4 is an isometric view of the embodiment of the cleaning kit illustrated in FIG. 3, having portions of the first, second and third compartments cut out for ease of illustration and understanding, and showing how a first compartment of the first embodiment may be rolled.

As shown in FIGS. 3-4, the first, second and third compartments 12, 14, 32 are linear with one another. In the second embodiment, the first and second compartments 12, 14 include the newly formed cleaning solution positioned therein and are rolled toward the third compartment 32 to open a seal 42 of the second openable barrier 36, as shown by the arrow 41 in FIG. 4. After the second openable barrier 36 is opened, the cleaning solution is directed into the third compartment 32 and saturates the wipes 34.

Figure 5A:
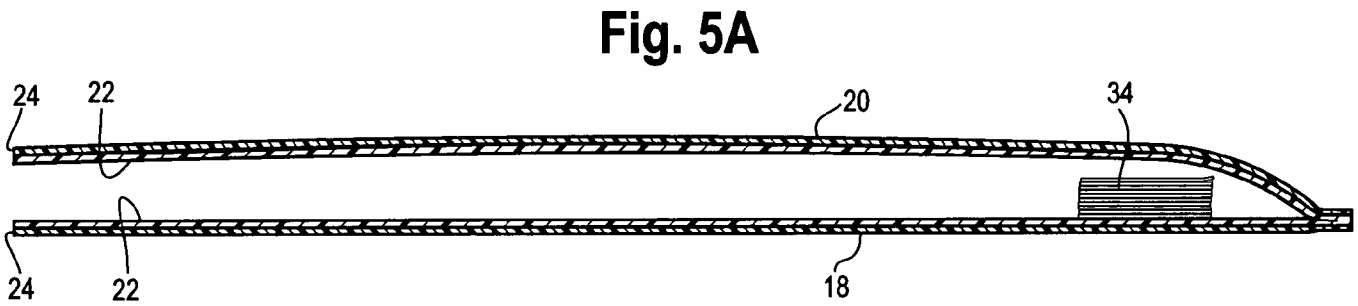
FIG. 5A shows a cross-sectional view of an unfinished second embodiment of the invention after a first step has been performed.
Figure 5B:
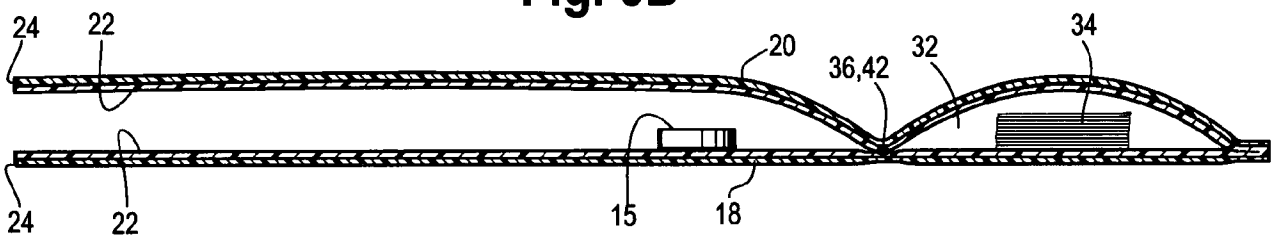
FIG. 5B shows a cross-sectional view of an unfinished second embodiment of the invention after a second step has been performed.
Figure 5C:
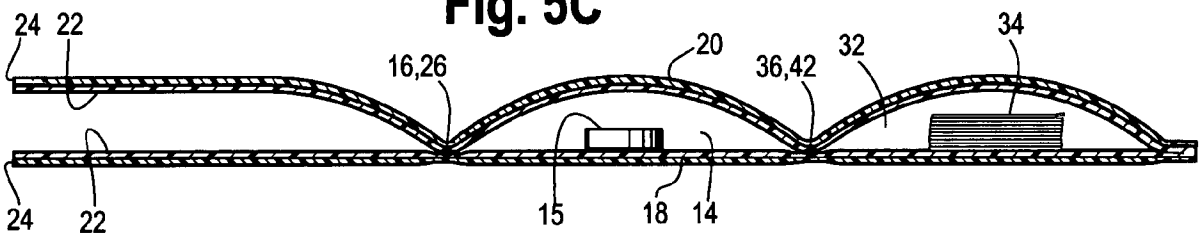
FIG. 5C shows a cross-sectional view of an unfinished second embodiment of the invention after a third step has been performed.

FIGS. 5A-5C show one embodiment of making the second cleaning kit embodiment 30. The periphery 38 (FIGS. 3 and 4) of the top and bottom panels 20, 18, except for a first end 40 of the first compartment 12 are heat sealed. It is anticipated that in use of the second embodiment, the seal at the periphery 38 may be weaker or stronger than the seals 26, 42 of the first and second openable barriers 16, 36. The sealed periphery 38 may then be opened for removal of the wipes 34 after they are saturated with the newly formed cleaning solution.

As shown in FIGS. 4 and 5A, the wipes 34 are positioned between the bottom and top panels 18, 20. The second openable barrier 36 is then formed by heat sealing and, with portions of the sealed periphery 38, defines the third compartment 32; the wipes are confined therein, as shown in FIG. 5B.

In a preferred embodiment, the seal 42 of the second openable barrier 36 is stronger than the seal 26 of the first openable barrier 16 to prevent unintended opening of the second openable barrier when the first compartment 12 is rolled toward the second compartment 14 to open the first openable barrier. As explained above, the strength of the barriers 16, 36 may be adjusted in various manners by, for example, adjusting the pressure, temperature and time of heat application (when using a heat seal type of barrier). Those of skill in the art will appreciate that, like the first openable barrier, the second openable barrier may be formed in various manners and materials, including through the use of adhesives.

As shown in FIGS. 4 and 5B, the cleaning solid 15 is positioned adjacent to the second openable barrier 36. Preferably, in the second embodiment, the cleaning solid 36 is in tablet form. In other embodiments and configurations, the cleaning solid 15 may be in a powder form but, in the second embodiment, is in a tablet form to prevent unwanted premixing. Specifically, when forming the compartments, if a powder is utilized, it may move into areas designated for the first compartment 12 or the first openable barrier 16, resulting in undesired mixing of the cleaning solid with the liquid 13 prior to use and/or to cleaning solid wastage if it is sealed into the first openable barrier.

As shown in FIGS. 4 and 5C, the first openable barrier 16 is formed by heat sealing and, as described above, in a preferred embodiment, includes a weaker seal 26 than the heat seal 42 of the second openable barrier 36. The second compartment 14 is formed between the first and second openable barriers 16, 36 and within portions of the sealed periphery 38. The cleaning solid 15 is confined therein.

As shown in FIGS. 3 and 4, liquid 13 is introduced into the area defined by the first openable barrier 16 and portions of the sealed periphery 38. The first end 40 of the first compartment 12 is then heat sealed so that the first end, portions of the sealed periphery 38 and the first openable barrier form the first compartment 12 with the liquid 13 positioned therein. As provided above, the seal strength of the first end 40 may be weaker or stronger than the seal strength of the sealed periphery 38 or the first or second openable barriers 16, 36. The cleaning kit 30 is then completed and the first and second openable barriers 16, 36 may be opened as desired when wipes 34 saturated with cleaning solution of sufficient potency are desired.

Note that the cleaning solution kit 10 of the first embodiment may be manufactured in a similar fashion except that the cleaning solution kit does not include the third compartment and, therefore, steps required for manufacturing the third compartment need not be followed when manufacturing the cleaning solution kit of the first embodiment.

Those of skill in the art will appreciate that in addition to the three compartment linear configuration shown in FIGS. 3-5, other configurations of the invention are possible. Such configurations include, for example, vertical alignment of the compartments, or configurations in which one of the compartments is positioned within the other compartment or all of the compartments are positioned within a larger compartment. To prevent possible entrapment of components within the seals, the compartments can alternately be formed by hard-sealing three edges first and frangible sealing the compartments. The compartments are then filled with the appropriate items and the open fourth edge is hard sealed. Further, those of skill in the art will appreciate that methods and materials in addition to the heat sealing methods provided above may be used to form the sealed periphery, the first and second openable barriers or the sealed first end.

Figure 6:
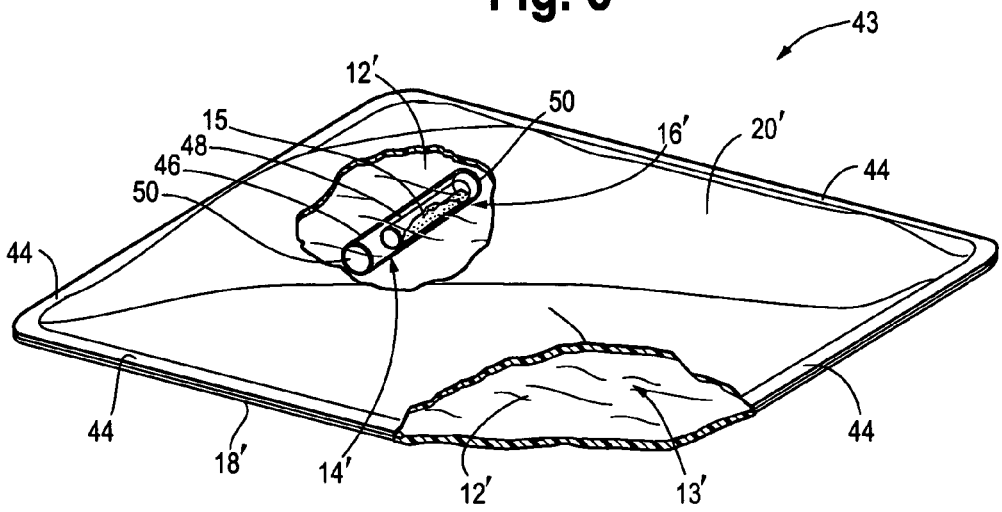
FIG. 6 is an isometric view of a third embodiment of a cleaning solution kit of the invention with portions of the first compartment cut out; and, FIG. 7 is an isometric view of a fourth embodiment of a cleaning kit of the invention with portions of the first and third compartments cut out.

A third embodiment of the invention comprises the cleaning solution kit 43 shown in FIG. 6. The third embodiment cleaning solution kit 43 includes a second compartment 14' positioned within the first compartment 12'. The cleaning solid 15 is positioned within the second compartment 14' and is isolated from the liquid 13, which is positioned within the first compartment 12', by a first openable barrier 16'.

In one embodiment, the first compartment is comprised of top and bottom panels 20', 18' that are sealed to one another at a periphery 44. Preferably, the top and bottom panels 20', 18' are comprised of a material that prevents leakage of the liquid 13 and that prevents unintended tearing of the panels. In one specific embodiment, the top and bottom panels 20', 18' are comprised of 48-gauge high barrier polyester and are heat sealed to one another. Those of skill in the art appreciate that, in other embodiments, the top and bottom panels may be comprised of different materials, have more than one layer and may be sealed to one another in different manners, such as by using adhesives.

The third embodiment cleaning solution kit 43 includes a second compartment 14' that has a squeezable plastic tube 46. The first openable barrier 16' includes a crushable glass vial 48 positioned within the plastic tube 46 and liquid resistant plugs 50 positioned at the ends of the plastic tube. Thus, when a user desires to form the cleaning solution, he may squeeze the plastic tube 46, which will press down and crush the glass vial 48. Also, squeezing the tube 46 will cause an increase of pressure within the tube, resulting in the liquid resistant plugs 50 to be forced off of the ends of the tube. Thus, the liquid 13 will enter into the tube 46 and vial 48 and mix with the cleaning solid 15 stored therein.

Those of skill in the art will appreciate that other forms of first and second compartments and first openable barriers may be used, for example a smaller bag including a frangible connection formed at a portion of the periphery thereof, a crushable glass vial (without the plastic tube and liquid resistant plugs), and the like.

The cleaning solid 15 within the second compartment 14' is in a solid form and may be either in tablet or powder form. Preferably, in one embodiment, the cleaning solid 15 is in powder form to expedite mixing with the liquid 13 and thus expedite forming the cleaning solution.

Figure 7:
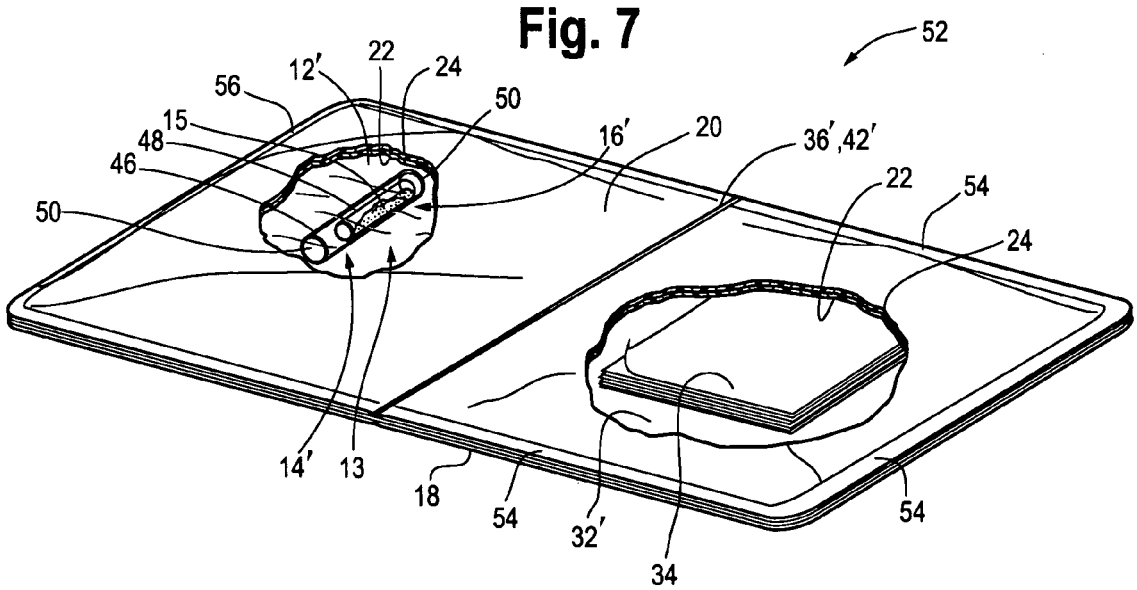

A fourth embodiment of the invention comprises the cleaning kit 52 shown in FIG. 7. The fourth embodiment cleaning kit 52 includes the two compartment configuration of the third embodiment 43 and an additional third compartment 32'. In one embodiment, the first and third compartments 12', 32' are formed from top and bottom panels 20, 18 that preferably comprise inner and outer layers 22, 24. The outer layer 24 is air and liquid resistant and the inner layer 22 provides control of sealing strength. In a specific embodiment, the outer layers 24 include 48-gauge high barrier polyester and the inner layers 22 include two mil low density polyethylene, like the layers used in the first embodiment cleaning solution kit 10. The third compartment 32' also includes wipes 34 that are isolated from the cleaning solid 15 and liquid 13 of the first and second compartments 12', 14' by a second openable barrier 36' and the first openable barrier 16'.

The second openable barrier 36' is preferably opened a predetermined time after the first openable barrier 16' is opened, during which time the cleaning solid 15 and liquid 13 are mixing to form the cleaning solution. After the cleaning solution is formed and the second openable barrier 36' is opened, the cleaning solution enters into the third compartment 32' and saturates the wipes 34.

As shown in FIG. 7, the first and third compartments 12', 32' are linear with one another. In the fourth embodiment, the first and second compartments 12', 14' include the newly formed cleaning solution positioned therein and are rolled toward the third compartment 32' to open the second openable barrier 16'. The cleaning solution is directed into the third compartment 32' and saturates the wipes 34.

Those of skill in the art will appreciate that, in other embodiments, there may be different configurations of the first and third compartments. For example, the third compartment may be positioned on top of the first compartment, or both the first and third compartments may be positioned within a larger container.

In one embodiment, while manufacturing the fourth embodiment cleaning kit 52, the peripheries 54 of the top and bottom panels 18, 20 are sealed together, except for a first end 56. The wipes 34 are positioned in the area formed by the sealed periphery 54, and the bottom and upper panels 18, 20 are heat sealed together to form the seal 42' of the second openable barrier 36'. The wipes 34 are confined within the third compartment 32', which is the area within the sealed periphery 54 and the second openable barrier 36'.

The second compartment 14' is positioned within the first compartment 12', and the liquid 13 is poured into the first compartment 12'. The first end 56 of the first compartment 12' is then sealed to itself to form the first compartment, defined by the first end, the second openable barrier 36' and portions of the sealed periphery 54. Those of skill in the art will appreciate that various methods and materials may be used to form the sealed periphery and the second openable barrier, such as the use of adhesives, heat sealing and the like.

Those of skill in the art will appreciate that several different types of cleaning solutions may be formed using the cleaning solution kits and cleaning kits of the invention. By forming the cleaning solution using the cleaning solution and cleaning kits of the invention, the cleaning solutions are more potent when actually used as opposed to using a prepared liquid cleaning solution that has been in storage. Specifically, the cleaning solutions include an active cleaning agent, such as chlorine in liquid bleaches, that deteriorates over time for various reasons. For example, deterioration may arise from hydrolysis reactions between the cleaning agent and water molecules.

To reduce cleaning agent deterioration, according to embodiments of the cleaning solution and cleaning kits of the invention, a cleaning solid is combined with a liquid to form the cleaning solution at the point of use. The formed cleaning solution includes the active cleaning agent, which is much less susceptible to deterioration because the cleaning solution is formed around the time of use and is used to clean the desired surfaces before substantial degradation can occur. In a preferred embodiment, the newly formed cleaning solution is utilized within twenty-four hours after it has been formed. In other embodiments, depending on the desired cleaning agent potency, the newly formed cleaning solution may be utilized within a shorter or after a longer time than the twenty-four hour period of the preferred embodiment.

In some embodiments, the cleaning solid 15 may include other ingredients. For example, when used in tablet form, the cleaning solid 15 may include effervescing agents for reacting with water to form carbon dioxide to break up the tablet. The cleaning solid 15 may also include neutralizing agents to maintain the pH of the cleaning solution after it is formed. In some embodiments, the cleaning solids 15 may also include the active cleaning agent that various organizations, such as the U.S. federal government, provide concentration guidelines for.

In one embodiment, the cleaning solid 15 comprises sodium dichloroisocyanurate (NaDCC) and the liquid 13 comprises water; the NaDCC and water are combined to form a cleaning solution that comprises liquid bleach.

The cleaning solid 15 may be used in either tablet or powder form and, is a preferred embodiment, in addition to NaDCC, 1,3,5-triazine 2,4,6-trione 1,3 dichlorosodium salt, (Chemical Abstract Service, CAS, No. 2893-78-9), the cleaning solid tablet or powder includes other ingredients, such as: adipic acid (CAS No. 000124-04-9); and, sodium carbonate (CAS No. 000497-19-8). The NaDCC tablet is commercially available from Medentech Ltd. of Whitemill Industrial Estate, Wexford, Ireland. NaDCC tablets are also commercially available from Activon Products of Beaver Dam, Wis. 53916. The liquid 13 is preferably water and, depending on purity tolerances, may be tap water, deionized water or distilled water.

Preferably, in the cleaning kit embodiments 30, 52, wipes 34 are utilized and are comprised of a polyester knit. In other embodiments, the wipes may be comprised of polypropylene or another suitable, compatible material.

When using the cleaning solution kit 10, 43 to form cleaning solution and subsequently wet wipes 34 or when using the cleaning kit 30, 52 with wipes included therein, the following amounts and concentrations of cleaning solid 15 and liquid 13 were found to form a cleaning solution to adequately saturate the wipes and included at least 1000 ppm available chlorine cleaning solution:

(a) 1 gm of Medentech tablet having 0.4 gms of NaDCC (which includes 250 mg of active chlorine); 200 mls of deionized water; and 10 wipes;

(b) 1 gm of Medentech tablet having 0.5 gms of NaDCC (which includes about 330 mg of active chlorine); 300 mls of deionized water; and 15 wipes; and, (c) 1.4 gm of Effersan tablet from Activon having 0.694 gms of NaDCC (which includes about 450 mg of active chlorine); 400 mls of deionized water; and 20 wipes.

The number of actual wipers and liquid is to be determined by the wiper absorptive capacity and the degree of desired saturation.

In other embodiments, the cleaning solid 15 may comprise calcium hypochlorite or chloramine-T (sodium n-chloro-paratoluene sulfonamide), and the liquid 13 may comprise water. The two may then be combined to form a cleaning solution comprising a hypochlorite or chloramine based bleach.

Those of skill in the art will appreciate that the cleaning solution kits 10, 43 and cleaning kits 30, 52 of the invention may be used to form numerous other types of cleaning solutions, using various cleaning solids 15 and liquids 13. For example, halogen based cleaning solutions may be used that are based on chlorine, bromine or iodine. For iodine based solutions, a detergent or surfactant, such as non-ionic ethoxylated, nonylphenol or polyvinyl pyrrolidone may be mixed with iodine to form an iodophor (iodine dissolved or complexed in micelles of surfactant, detergent or other complexing agent) as the cleaning solid 15. The cleaning solid 15 may then be mixed with a liquid 13, such as water, to form the cleaning solution.

In addition, the cleaning solution may comprise halogen-free oxygen based bleaches, such as sodium perborate, sodium percarbonate, hydrogen peroxide or peracetic acid. Other types of cleanings solutions include phenolic compounds, quaternary ammonium compounds, alcohols and aldehydes, such as glutaraldehydes and formaldehydes. Those of skill in the art will appreciate that numerous types of cleaning solids 15 may be mixed with various liquids 13. Typically, water will be used to form the desired cleaning solutions. The cleaning solids 15 may be chosen based on the specific requirements of the cleaning solution. The type and amount of the cleaning solid 15 and liquid 13 can be readily discerned by those of ordinary skill in the art. Cleaning solid 15 is not meant to exclude liquid cleaning agents which may be unstable or deteriorate over time when mixed with liquid 13.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be made to the invention without departing from the true spirit and scope of the novel concepts of the present invention. It is to be understood that no limitation with respect to the specific embodiments illustrated is intended or to be inferred. The disclosure is intended to cover all such modifications as fall within the scope of the invention.

What is claimed is:

1. A kit of multiple compartments in linear configuration with each other for providing a cleaning solution, the kit comprising in combination:

a first, second and third compartment formed of a top and a bottom panel, each panel formed of an inner layer including 2 mil low density polyethylene (LUPE), and an outer layer of 48-guage high barrier polyester, the two layers of each panel sealed together by co-extrusion;

a liquid disposed within the first compartment;

the second compartment isolated from the liquid positioned within a first compartment;

a cleaning solid disposed within the second compartment;

a third compartment having wipes being disposed within the third compartment;

a first openable barrier isolating the liquid in the first compartment from the cleaning solid in the second compartment; and;

a second openable barrier isolating the wipes in the third compartment from the liquid in the first compartment and the cleaning solid in the second compartment, wherein, when the first openable barrier is opened by rolling the first compartment toward the second compartment the cleaning solid in the second compartment mixes with the liquid in the first compartment to form a cleaning solution and wherein, after the cleaning solution is formed, the second openable barrier is opened by rolling the first and second compartments toward the third compartment to direct the cleaning solution into the third compartment and the cleaning solution wets and saturates the wipes therein.

2. The kit of claim 1 wherein the first openable barrier is a heat seal provided by applying heat to the two panels of the first compartment at a desired location at an adjusted temperature, pressure, seal width, and time of application of heat so that the top and bottom layers of the two panels seal to each other to form a first openable barrier.

3. The kit of claim 1, wherein the cleaning solid is a tablet.

4. The kit of claim 1 wherein the second openable barrier is a second heat seal provided by heat sealing the two panels of the second compartment so that the seal of the second openable barrier is stronger than the seal of the first openable barrier to prevent unintended opening of the second openable barrier when the first openable barrier is provided by adjustment of the pressure, temperature and time of heat application to the location of the second openable barrier.

5. The kit of claim 1 wherein the first compartment is positioned linearly adjacent to the second compartment so that the first and second compartments are linearly configured to allow for rolling the first compartment toward the second compartment to open the first openable barrier.

6. The kit of claim 1, wherein the cleaning solid is one of: (a) sodium dichloroisocyanurate, (b) calcium hypochlorite, (c) chloramines-T, and (d) and iodophor.

7. The kit of claim 1, wherein the cleaning solid is one or more of NaDCC (1,3,5-triazine 2,4,6-trione 1,3 dichlorosodium salt); adipic acid; and sodium carbonate.

8. The kit of claim 1, wherein the cleaning solution is one or more of: a liquid bleach, a halogen based cleaning solution, a halogen-free oxygen based bleach, a phenolic compound, a quaternary ammonium compound, an alcohol, or an aldehyde.

9. The kit of claim 1 wherein the first compartment, the second compartment and the third compartment further include top and bottom panels comprised of materials that are heat sealable to one another.

10. The kit of claim 9, wherein the top and bottom panels each have inner and outer layers.

11. A method of cleaning an area using a kit having a first compartment with a liquid positioned therein that is isolated from a cleaning solid positioned in a second compartment by a first openable barrier and a third compartment having wipes disposed therein isolated from the first and second compartments, the wipes being isolated in the third compartment by a second openable barrier, the method comprising:

opening the first openable barrier;

mixing the cleaning solid with the liquid to form a cleaning solution;

opening the second openable barrier to expose the wipes;

removing the wipes from the third compartment; and wiping the area with the cleaning solution wetted wipes.

* * * * *